US006386383B1

(12) United States Patent
Roudonis

(10) Patent No.: US 6,386,383 B1
(45) Date of Patent: May 14, 2002

(54) COLLAPSIBLE SHIPPING CONTAINER

(75) Inventor: Robert A. Roudonis, Trenton, MI (US)

(73) Assignee: F. X. Coughlin Co., Southfield, MI (US)

( * ) Notice: Subject to any disclaimer, the term of this patent is extended or adjusted under 35 U.S.C. 154(b) by 0 days.

(21) Appl. No.: 09/944,241

(22) Filed: Aug. 31, 2001

(51) Int. Cl.[7] ..... B65D 19/00
(52) U.S. Cl. ..... 220/7; 220/1.5; 220/6
(58) Field of Search ..... 220/1.5, 6, 7, 4.28, 220/4.33

(56) References Cited

U.S. PATENT DOCUMENTS

| | | | | | |
|---|---|---|---|---|---|
| 3,294,034 | A | * | 12/1966 | Bodenheimer et al. | 220/1.5 X |
| 3,424,331 | A | * | 1/1969 | Borden | 220/1.5 |
| 3,556,339 | A | | 1/1971 | Lind | 220/60 |
| 3,746,203 | A | | 7/1973 | Cipolla | 220/6 |
| 4,422,313 | A | | 12/1983 | VanderWyde | 70/167 |
| 4,428,491 | A | * | 1/1984 | Mittelmann et al. | 220/1.5 |
| 4,860,912 | A | * | 8/1989 | Kupersmit | 220/1.5 |
| 5,328,042 | A | | 7/1994 | Heise | 220/7 |
| 5,377,856 | A | * | 1/1995 | Brierton | 220/1.5 |
| 5,611,449 | A | | 3/1997 | Pedersen | 220/6 |
| 5,746,341 | A | | 5/1998 | Olson | 220/6 |
| 5,862,931 | A | | 1/1999 | Cox et al. | 220/6 |
| 5,890,612 | A | | 4/1999 | Coppi | 220/7 |
| 5,941,405 | A | | 8/1999 | Scales et al. | 220/1.5 |
| 5,967,356 | A | | 10/1999 | Laarhoven et al. | 220/6 |
| 5,992,664 | A | | 11/1999 | Trapp et al. | 220/6 |
| 6,006,918 | A | | 12/1999 | Hart | 206/600 |
| 6,053,346 | A | | 4/2000 | Niles et al. | 220/62 |
| 6,056,177 | A | | 5/2000 | Schneider | 224/401 |
| 6,062,410 | A | | 5/2000 | Bradford et al. | 220/6 |
| 6,113,031 | A | * | 9/2000 | Williams et al. | 220/1.5 X |
| 6,131,757 | A | | 10/2000 | Clark et al. | 220/7 |

* cited by examiner

*Primary Examiner*—Steven Pollard
(74) *Attorney, Agent, or Firm*—Howard & Howard

(57) ABSTRACT

A collapsible container (10) includes a plurality of sidewalls (12, 14 and 16) movable from a collapsed storage position to a shipping position extending upwardly from a bottom (19) to top extremities to define a closed compartment. The container assembly (10) is characterized by the buckles (28) disposed on the interior of the sidewalls (12, 14, and 16) and the roof (20) to prevent access thereto in the shipping position. Each buckle strap (24) has a fixed end (30) secured to the interior of one of the sidewalls (12, 14, and 16) by a rivet (32) and each of the tie straps (26) extends from an attached end (36) attached by rivets (38) to flaps (23) depending from the roof (20). The sidewalls (12, 14, and 16) include strap holes 40 extending therethorough and each of the tie straps (26) extend from the attached end (36) at one of the flaps (23) downwardly on the exterior of the adjacent sidewall (12, 14 or 16) and into one of the holes (40) to the interior of the compartment and into engagement with one of the buckles (28).

13 Claims, 4 Drawing Sheets

COLLAPSIBLE SHIPPING CONTAINER

BACKGROUND OF THE INVENTION

1. Field of the Invention

The subject invention relates to a shipping container that is collapsed when emptied for return to a destination for erection to a shipping position for shipping additional goods therein.

2. Description of the Prior Art

Such collapsible shipping containers are well known and frequently include a plurality of sidewalls movable from a collapsed storage position sandwiched with one another to a shipping position extending upwardly from a bottom to top extremities to define a closed compartment. A separate roof is disposed in overlying relationship with the top extremities of the sidewalls in the shipping position. A plurality of strap units, each including a buckle connected to a buckle strap for connection to a tie strap, interconnect the roof and the side walls for securing the roof in the overlying relationship with the side walls.

These buckles are disposed on the exterior of the container and allow easy access to view the contents of the container. This easy access presents a problem as many different people between the shipper and the ultimate destination handle the containers. For example, garments on hangers are frequently shipped in such collapsible containers and the temptation for handlers to have a peek at the garments is too great to resist. Consequently, many garments and other goods are lost during shipment. There is a need for a simple solution that does not greater change the current shipping containers in construction or operation yet makes it more difficult to peek into the container and/or to gain access to the container without being noticed.

SUMMARY OF THE INVENTION AND ADVANTAGES

The subject invention provides a collapsible shipping container assembly that makes it more difficult to peek into the container and/or to gain access to the container without being noticed. A plurality of sidewalls are moved from a collapsed storage position sandwiched with one another to a shipping position extending upwardly from a bottom to top extremities to define a closed compartment on the interior of the sidewalls. A roof separate from the sidewalls is disposed in overlying relationship with the top extremities of the sidewalls. The roof and the sidewalls are interconnected for securing the roof in the overlying relationship with the side walls by using a plurality of strap units each of which includes a tie strap and a buckle strap connected to a buckle. The collapsible container is characterized by disposing the buckles on the interior of the walls and the roof to prevent access thereto and connecting the tie straps to the buckles on the inside of the compartment.

By disposing the buckles on the interior of the container, it is very difficult for an unauthorized person to have a peek into the container. Although access is possible, it would require much more effort and time, thereby making it difficult without being observed.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Referring to the Figures, wherein like numerals indicate like or corresponding parts throughout the several views, a collapsible shipping container assembly is generally shown at 10.

Figure 1:
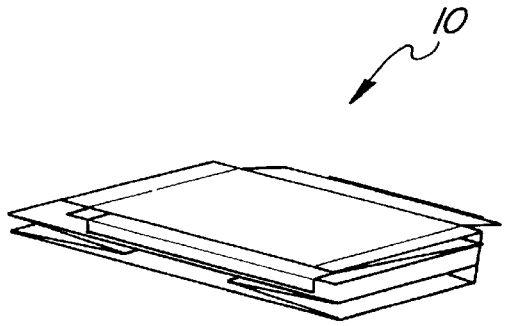
FIG. 1 is a perspective view of a collapsed container.
Figure 2:
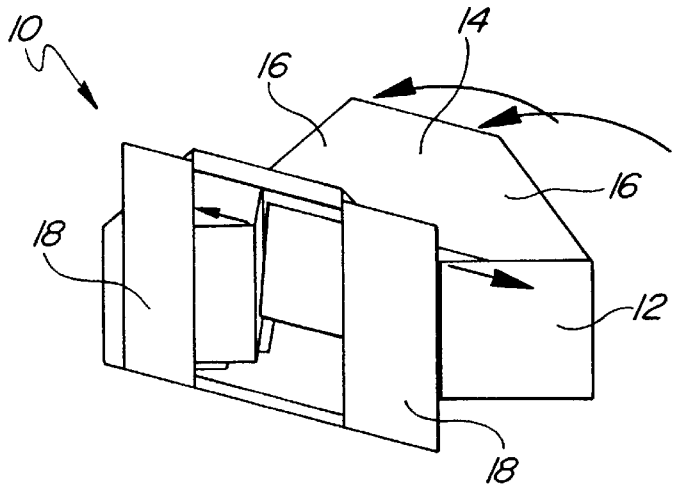
FIG. 2 is perspective view showing the sidewalls of the container being moved to the shipping position.

A plurality of sidewalls 12, 14 and 16 are movable from a collapsed storage position sandwiched with one another, as shown in FIG. 1, to a shipping position extending upwardly from a bottom 19 to top extremities to define a closed compartment on the interior of the sidewalls 12, 14 and 16. More specifically, the sidewalls 12, 14 and 16 define low side panels 12 and high ends with the ends having a high center panel 14 and tapered panels 16 extending therefrom in opposite directions downwardly to the low side panels 12. All of the panels 12, 14 and 16 are sonic welded together. The sidewalls 12, 14 and 16 include at least one door 18 for access to the compartment, there being two doors as illustrated and in the position of the center panels 14 but at the opposite end of the container 10. In the preferred embodiment with two doors 18, the inner edge of one door 18 includes a strip 17 of either hook or loop. The outer edge of the second door also includes a strip 17 of the corresponding hook or loop. The edge of the doors 18 slightly overlap and the strip of hook and loop mesh together to form a seal and keep the door 18 closed.

A roof, generally indicated at 20, is separate from the sidewalls 12, 14 and 16 and is disposed in overlying relationship with the top extremities of the sidewalls 12, 14 and 16 in the shipping position. The roof 20 includes a horizontal panel 21 overlying the top extremities of the center panel 14 and slanting panels 22 overlying the top extremities of the tapered panels 16. The roof 20 may be made of plastic and the panels 21 and 22 thereof may be sonic welded together. The roof 20 includes flaps 23 for extending downwardly along the exterior of the top extremities of the sidewalls 12, 14, 16 and 18

Pluralities of strap units interconnect the roof 20 and the sidewalls 12, 14, and 16 for securing the roof 20 in the overlying relationship with the sidewalls 12, 14, and 16. Each of the strap units includes a buckle strap 24 and a tie strap 26 and a buckle 28 connected to the buckle strap 24 for connecting the straps 24 and 26 together.

The container assembly 10 is characterized by the buckles 28 being disposed on the interior of the sidewalls 12, 14, and 16 and the roof 20 to prevent access thereto in the shipping position. Each buckle strap 24 extends to a fixed end 30 from the buckle 28 and the fixed end 30 is secured to the interior of one of the sidewalls 12, 14, and 16 by a rivet 32. Each of the tie straps 26 extends between a free end 34 and an attached end 36 attached to the roof 20 by rivets 38. More specifically, the attached ends 36 of the tie straps 26 are attached by the rivets 38 to the flaps 23 of the roof 20. The attached ends 36 of the tie straps 26 are sandwiched between the flaps 23 and the sidewalls 12, 14, and 16 in the shipping position. (The rivets 32 and 38 may be identical but are given different reference numbers for clarity of description.)

The sidewalls 12, 14, and 16 include a plurality of strap holes 40 extending therethorough and each of the tie straps 26 extends from the attached end 36 thereof at one of the flaps 23 downwardly on the exterior of the adjacent sidewall 12, 14 or 16 and into one of the holes 40 to the interior of the compartment and into engagement with one of the buckles 28 in the shipping position.

As alluded to above, the center panels 14 of one of the end sidewalls define doors 18 for access to the interior of the container. And in order to gain access to the container 10, a plurality of door strap units 42 each include a buckle 44 disposed on the exterior of the doors 18 for maintaining the doors 18 in a closed position to close the compartment. The door strap units 42 also include a tie strap 26 attached to the interior of the flaps 23 of the roof 20 and which extend into holes 48 in the doors 18 and out holes 46 to engage a buckle 44. The buckles 44 on the exterior of the doors 18 are attached to the free ends of buckle straps 50.

Figure 3:
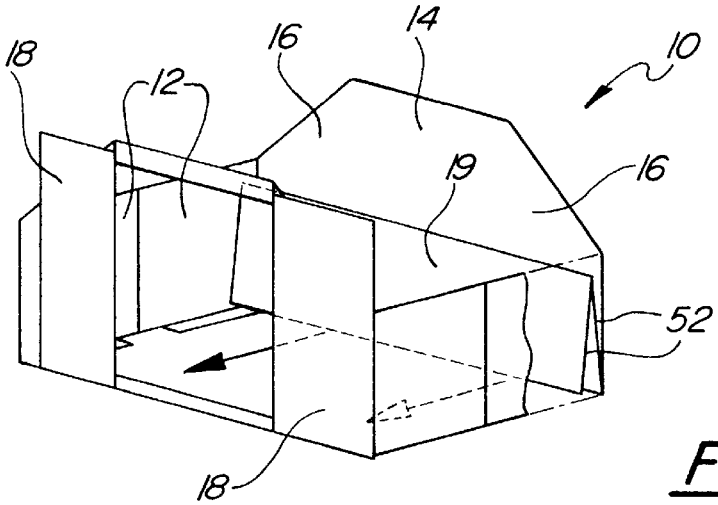
FIG. 3 is a perspective view showing the bottom of the container being moved to the shipping position.
Figure 4:
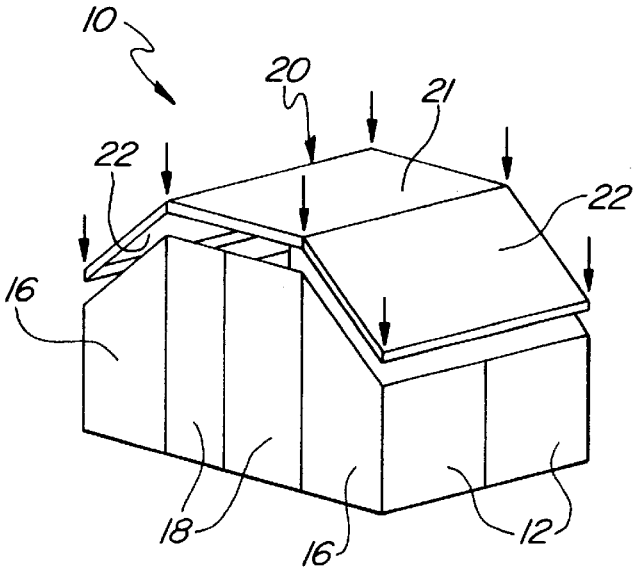
FIG. 4 is a perspective view showing the roof being placed in overlying relationship with the sidewalls.
Figure 7:
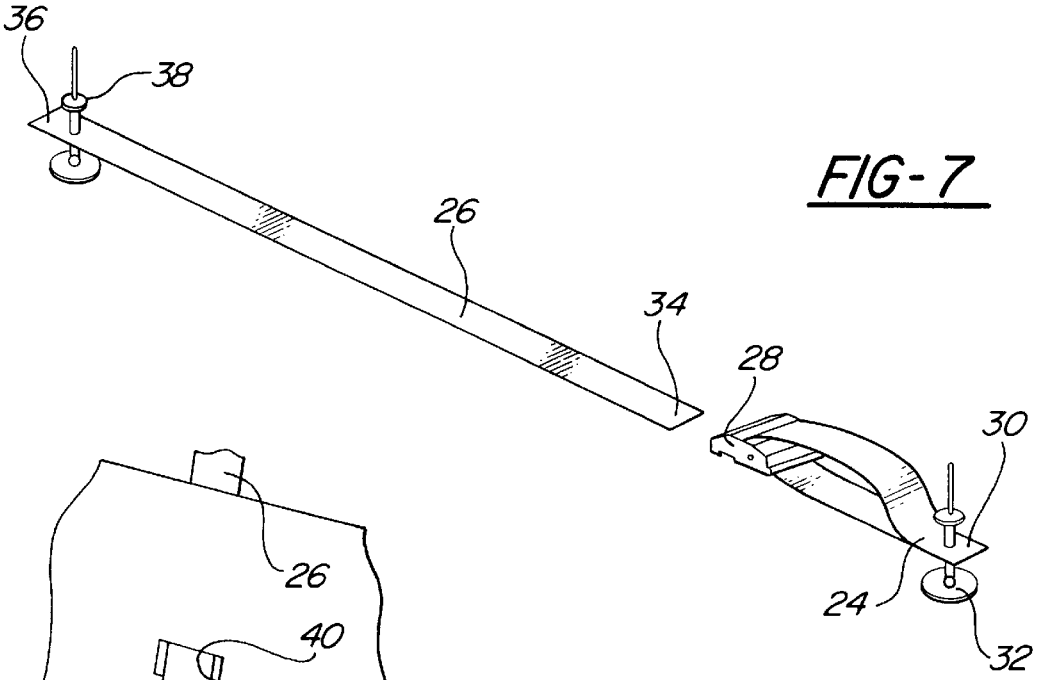
FIG. 7 is a perspective view of a strap unit used in the subject invention.
Figure 8:
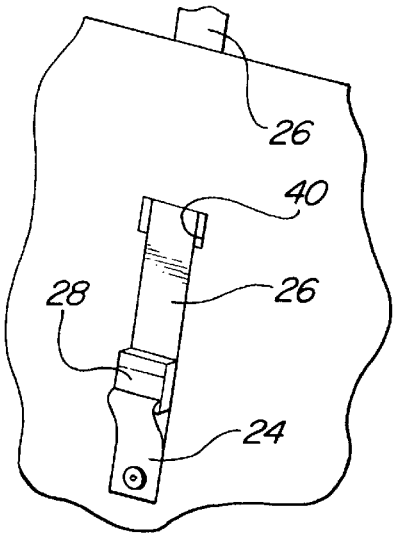
FIG. 8 is an enlarged fragmentary view showing a strap unit from the interior of the compartment.
Figure 6:
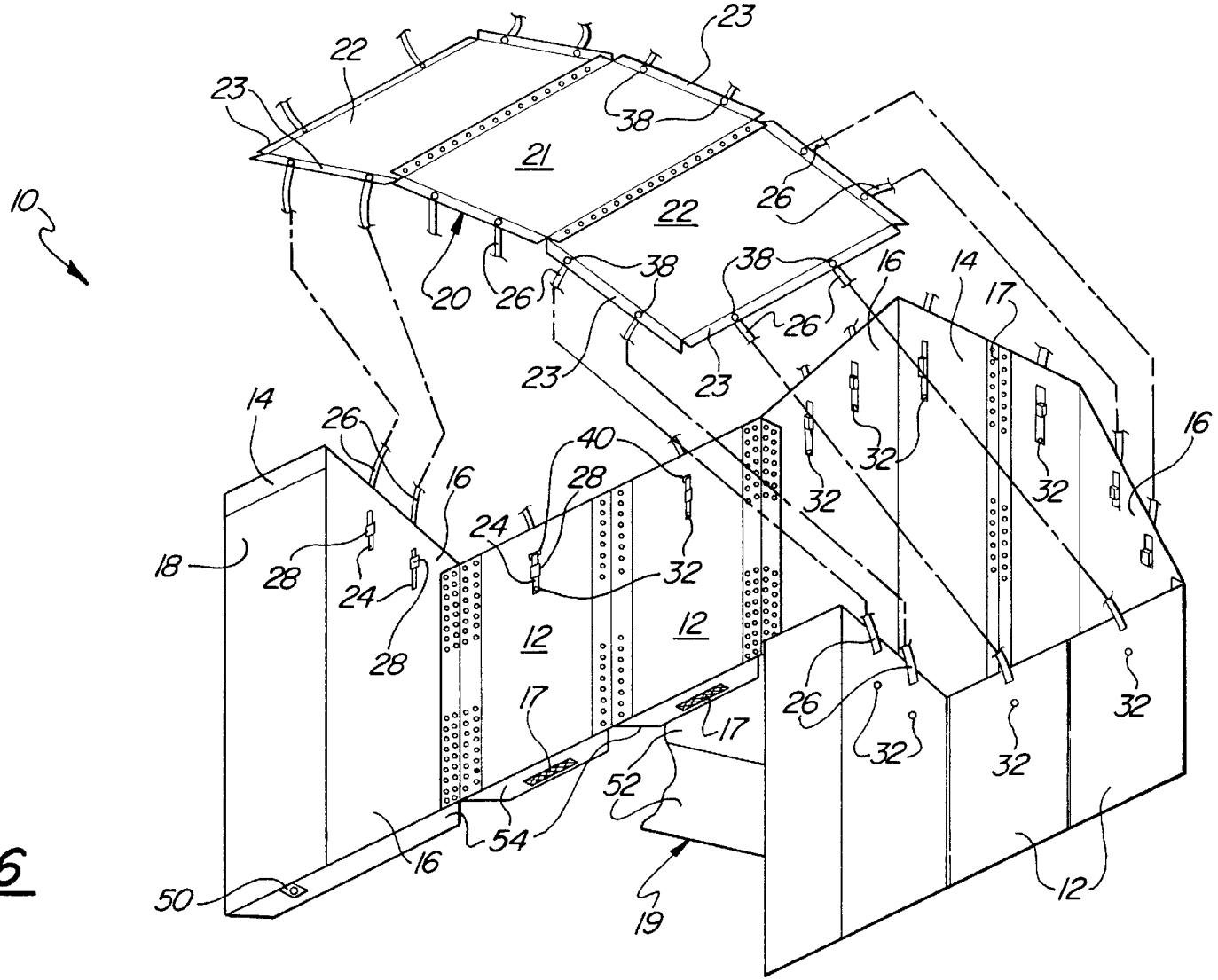
FIG. 6 is an exploded perspective view showing the disposition of the straps.

The bottom 19 comprises two foldable panels 52 as best shown in FIG. 3. The sidewalls 12, 14 and 16 include bottom flanges 54 as shown in FIG. 6 upon which the bottom panels 52 rest. As with the edges of the doors 18 described above, the top surfaces of the bottom flanges 54 includes a strip 17 of hook or loop. The bottom surfaces of the bottom panels 52 also include a strip 17 of the corresponding hook or loop. When the bottom panels 52 rest upon the bottom flanges 54 the hook and loop mesh together to attach the panels 52 to the flanges 54. The buckle straps for the doors 18 are attached to the bottom flanges 52 by rivets.

Figure 5:
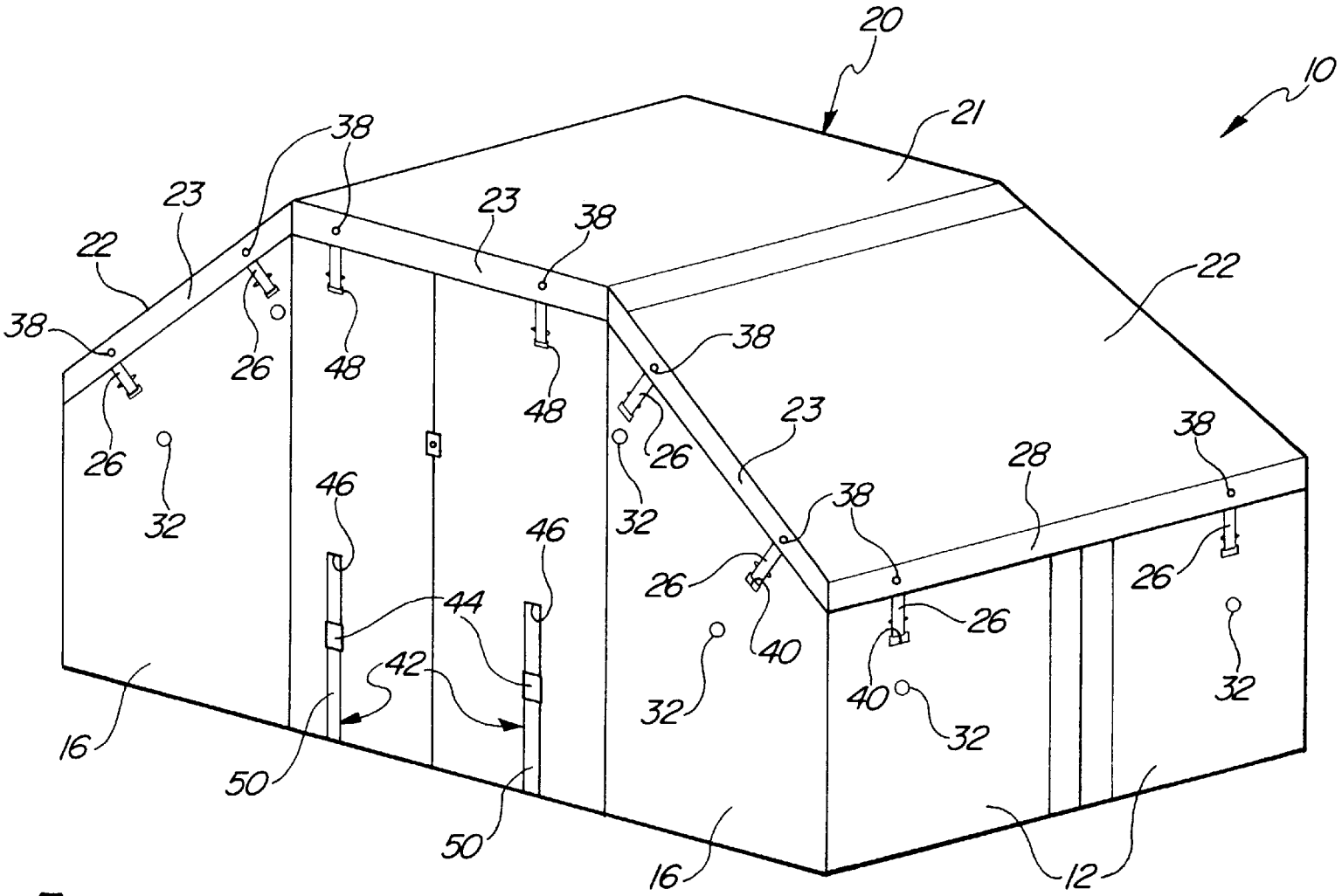
FIG. 5 is a perspective view showing the container in the shipping position.

The invention also includes a method of using the collapsible shipping container by moving a plurality of sidewalls 12, 14 and 16 movable from a collapsed storage position (FIG. 1) sandwiched with one another to a shipping position (FIG. 5) extending upwardly from a bottom 19 to top extremities to define a closed compartment on the interior of the sidewalls 12, 14 and 16. This is followed by disposing a roof 20 separate from the sidewalls 12, 14 and 16 in overlying relationship with the top extremities of the sidewalls 12, 14 and 16 interconnecting the roof 20 and the sidewalls 12, 14 and 16 for securing the roof 20 in the overlying relationship with the sidewalls 12, 14 and 16 with a plurality of strap units, each of which includes a buckle strap 24 connected to a buckle 28 and a tie strap 26. The method is characterized by disposing the buckles 28 on the interior of the sidewalls 12, 14 and 16 and the roof 20 to prevent access thereto and connecting the tie straps 26 to the buckles 28 inside the compartment.

The method may include the step of securing 32 a fixed end 30 of each buckle strap 24 which is displaced from the buckle 28 to the interior of one of the sidewalls 12, 14, and 16 and attaching 38 an attached end 36 of each of the tie straps 26 to the roof 20.

Another step may be disposing each of the tie straps 26 downwardly from the roof 20 on the exterior of the adjacent sidewall 12, 14 and 16 and through a hole 40 in the sidewall 12, 14 and 16 to the interior of the compartment and into engagement with one of the buckles 28. Yet another step may be disposing a door 18 in one of the sidewalls 12, 14, and 16 for access to the compartment, and disposing at least one door strap unit 42 having a buckle 44 on the exterior of the door 18 for maintaining the door 18 in a closed position to close the compartment.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. A collapsible shipping container assembly comprising;

a bottom (19), a plurality of sidewalls (12, 14 and 16) movable from a collapsed storage position sandwiched with one another to a shipping position extending upwardly from said bottom (19) to top extremities to define a closed compartment on the interior of said sidewalls (12, 14 and 16), a roof (20) separate from said sidewalls (12, 14 and 16) for overlying relationship with said top extremities of said sidewalls (12, 14, and 16) in said shipping position, a plurality of strap units interconnecting said roof (20) and said sidewalls (12, 14 and 16) for securing said roof (20) in said overlying relationship with said sidewalls (12, 14 and 16), each of said units including a buckle strap (24) and a tie strap (26) and a buckle (28) connected to said buckle strap (24) for connecting said straps (24, 26) together, said assembly characterized by said buckles (28) being disposed on the interior of said walls (12, 14 and 16) and said roof (20) to prevent access thereto in said shipping position.

2. An assembly as set forth in claim 1 wherein said buckle strap (24) extends to a fixed end (30) from said buckle (28) and said fixed end (30) is secured (32) to the interior of one of said sidewalls (12, 14, and 16).

3. An assembly as set forth in claim 2 wherein said sidewalls (12, 14 and 16) include at least one door (18) for access to said compartment, at least one door strap unit (42) including a buckle (44) disposed on the exterior of said door (18) for maintaining said door (18) in a closed position to close said compartment.

4. An assembly as set forth in claim 3 wherein each of said tie straps (26) extend between a free end (34) and an attached end (36) attached (38) to said roof (20).

5. An assembly as set forth in claim 4 wherein said roof (20) includes flaps (23) extending downwardly along the exterior of said top extremities of said sidewalls (12, 14, and 16) and said attached ends (36) of said tie straps (26) are attached to said flaps (23).

6. An assembly as set forth in claim 5 wherein said sidewalls (12, 14, and 16) include a plurality of strap holes (40) extending therethrough and each of said tie straps (26) extends from said attached end (36) thereof at one of the flaps (23) downwardly on the exterior of the adjacent sidewall and into one of said holes (40) to the interior of said compartment and into engagement with one of said buckles (28) in said shipping position.

7. An assembly as set forth in claim 6 wherein said attached ends (36) of said tie straps (26) are sandwiched between said flaps (23) and said sidewalls (12, 14, and 16) in said shipping position.

8. An assembly as set forth in claim 7 wherein said sidewalls (12, 14, and 16) define low side panels (12) and high ends with said ends having high center panels (14) and tapered panels (16) extending therefrom in opposite directions downwardly to said low side panels (12), said roof (20) includes a horizontal panel (21) overlying said center panel (14) and slanting panels (22) overlying said tapered panels (16).

9. An assembly as set forth in claim 8 wherein said door (18) is disposed in one of said center panels (14).

10. A method of using a collapsible shipping container assembly comprising the steps of;

moving a plurality of sidewalls (12, 14 and 16) movable from a collapsed storage position sandwiched with one another to a shipping position extending upwardly from a bottom (19) to top extremities to define a closed compartment on the interior of the sidewalls (12, 14 and 16), disposing a roof 20 separate from the sidewalls (12, 14 and 16) in overlying relationship with the top extremities of the sidewalls (12, 14 and 16), interconnecting the roof (20) and the sidewalls (12, 14, and 16) for securing the roof (20) in the overlying relationship with the sidewalls (12, 14 and 16) with a plurality of strap units each of which includes a buckle strap (24) connected to a buckle (28) and a tie strap (26), said method characterized by disposing the buckles (28) on the interior of the sidewalls (12, 14 and 16) and the roof (20) to prevent access thereto and connecting the tie straps (26) to the buckles (28) on the inside of the compartment.

11. A method as set forth in claim 10 including securing (32) a fixed end (30) of each buckle strap (24) which is displaced from the buckle (28) to the interior of one of the sidewalls (12, 14, and 16) and attaching (38) an attached end (36) of each of the tie straps (26) to the roof (20).

12. A method as set forth in claim 11 including disposing each of the tie straps (26) downwardly from the roof (20) on the exterior of the adjacent sidewall and through a hole (40) in the sidewall to the interior of the compartment and into engagement with one of the buckles (28).

13. A method as set forth in claim 12 disposing a door (18) in one of the sidewalls (12, 14 and 16) for access to the compartment, and disposing at least one door strap unit (42) having a buckle (44) on the exterior of the door (18) for maintaining the door (18) in a closed position to close the compartment.

* * * * *